United States Patent [19]

Lemire et al.

[11] Patent Number: 4,806,403

[45] Date of Patent: Feb. 21, 1989

[54] DECORATIVE MODULE HAVING A CONCAVE FACE

[76] Inventors: Gilbert Lemire, 1565, rue Victoria, Suite 209, St-Lambert, Quebec, Canada, J4R 1R6; Anastase Deslippe, 11A Rang St-Grégoire, Saint-Philippe, Quebec, Canada, J0L 2K0

[21] Appl. No.: 136,946

[22] Filed: Dec. 23, 1987

[51] Int. Cl.[4] ..... B65D 5/26

[52] U.S. Cl. ..... 428/34.1; 52/222; 428/174; 428/542.8

[58] Field of Search ..... 52/222, 406; 40/154, 40/155; D6/310, 300; 229/115, 116; 428/35, 36, 174, 542.8

[56] References Cited

U.S. PATENT DOCUMENTS

| | | | |
|---|---|---|---|
| D. 247,276 | 2/1978 | Smith | D6/310 |
| D. 268,316 | 3/1983 | Shamoon | D6/300 |
| 1,379,612 | 5/1921 | Bauer | 248/459 |
| 2,806,310 | 9/1957 | Boyd | 40/154 |
| 2,862,322 | 12/1958 | Ziegler | 40/154 |
| 4,212,124 | 7/1980 | Gammill | 40/155 |
| 4,371,575 | 2/1983 | Kerk | 428/174 X |
| 4,515,149 | 5/1985 | Sgroi et al. | 165/178 X |
| 4,523,405 | 6/1985 | Madonia | 428/174 X |
| 4,611,429 | 9/1986 | Kanies | 49/475 X |
| 4,660,323 | 4/1987 | Kanies | 49/475 X |

*Primary Examiner*—Henry F. Epstein

*Attorney, Agent, or Firm*—Oblon, Fisher, Spivak, McClelland & Maier

[57] ABSTRACT

There is disclosed a decorative module which can be used to decorate the face of a building or can also be used as a support for a picture or a painting. The decorative module is made of a single sheet of material, such as aluminum, and comprises a rectangularly shaped concave face derived from an intermediate portion of the sheet of material. Rearwardly and inwardly angled borders are formed along two opposite sides of the concave face. The remaining portions of the sheet of material can be folded at the rear of the concave face while engaging into one another. The concave face forms an arc of a circle whose height is at least 1/25th the length of the chord of the arc of a circle. The module is constructed and arranged to be self-supporting.

12 Claims, 3 Drawing Sheets

DECORATIVE MODULE HAVING A CONCAVE FACE

BACKGROUND OF THE INVENTION (a) Field of the Invention

The present invention relates to a decorative module. More aarticularly, the present invention is concerned with a unit which can be used to decorate the face of a building or the like. The unit according to the invention has also been found very convenient to be used as a canvas for a painting or the like.

(b) Description of Prior Art

It is well known that the field of decoration offers practically unlimited possibilities in terms of the materials used to produce a new effect. On the other hand, it is also known that aluminum and its alloys constitute a material of choice because it is relatively easy to work and does not oxidize rapidly.

In a slightly different line of thought, it was considered that a new decorative module would constitute an excellent support for a picture or a painting or the like, as a replacement for the standard canvas which has been in common use for ages.

The prior art has revealed a few designs based on the above ideas, but none of them can achieve the results which are obtained when utilizing the decorative module according to the present invention. This prior art is the following:

U.S. Pat. No. 2,862,322; Ziegler
U.S. Pat. No. 2,806,310; Boyd
U.S. Pat. No. 1,379,612; Baver
U.S. Pat. No. Des. 268,316; Shamoon
U.S. Pat. No. Des. 247,276; Smith.

SUMMARY OF INVENTION

The present invention relates to a decorative module made of a single sheet of material, which comprises a rectangularly shaped concave face derived from an intermediate portion of the sheet of material. Rearwardly and inwardly angled borders are formed along two opposite sides of the concave face, and means are provided to enable the remaining portions of the sheet of material to fold at the rear of the concave face and to engage into one another to form a rigid structure. The concave face forms an arc of a circle whose height is at least 1/25th the length of the chord of the arc of circle. The module is constructed and arranged to be self-supporting.

In accordance with a preferred embodiment of the invention, the concave face is derived from an off centered intermediate portion of the sheet of material. The remaining portions comprise a larger portion and a smaller portion and the larger portion folds over the smaller portion.

In accordance with another preferred embodiment of the invention, each angled border has a front edge and a rear edge, both edges being formed by bending the sheet of material along two different rectilinear parallel grooves formed therein, the rear edge being shorter than the front edge.

In accordance with another preferred embodiment of the invention, the decorative module comprises cuts made in the sheet of material from both sides of the latter, adjacent the opposite sides mentioned above. Each cut is aligned with one rear edge and reaches both ends thereof. The cuts enable to produce folds of the sheet of material parallel to the adjacent sides and perpendicularly to the rear edge. Each remaining larger and smaller portions are thereby formed with a pair of outer folds. The folds of the smaller portion is engaged by the folds of the larger portion, thus constituting the back of the decorative module.

In accordance with another preferred embodiment of the invention, the cuts define triangular portions with the ends of the front edges and the rear edges, and the triangular portion is inwardly bent against a corresponding angled border.

In accordance with another preferred embodiment of the invention, each border defines an acute angle with respect to the front face of the decorative module, and an obtuse angle with respect to the back thereof.

The decorative module can be made of any suitable material, but the preferred material is a metal, such as aluminum or alloys thereof.

BRIEF DESCRIPTION OF DRAWINGS

The invention will now be illustrated by means of the following drawings in which.

DESCRIPTION OF PREFERRED EMBODIMENTS

With reference to the drawings, it will be seen that the decorative module according to the invention is made from a single blank 1 which has a rectangular shape and will be prepared for bending and folding into the decorative module 3 according to the invention, in the following manner.

Figure 1:
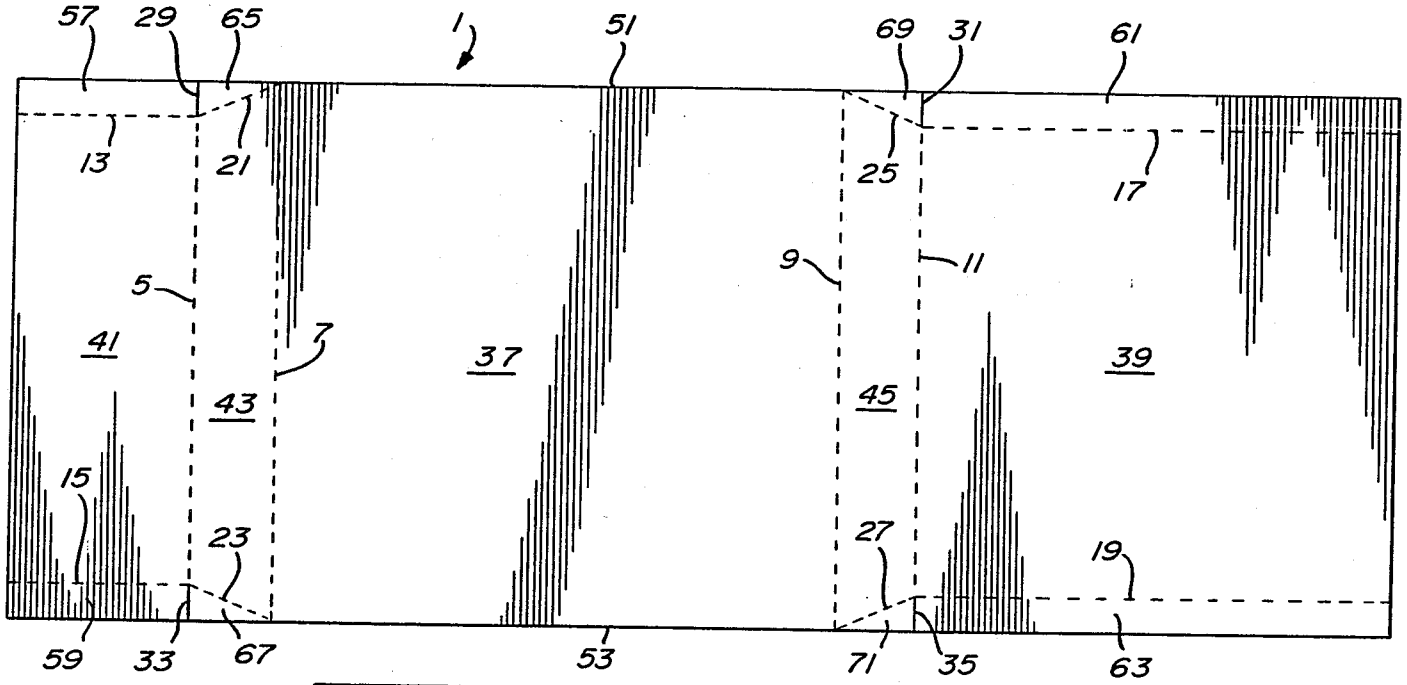
FIG. 1 is a view of the blank used to produce the decorative module according to the invention.
Figure 2:
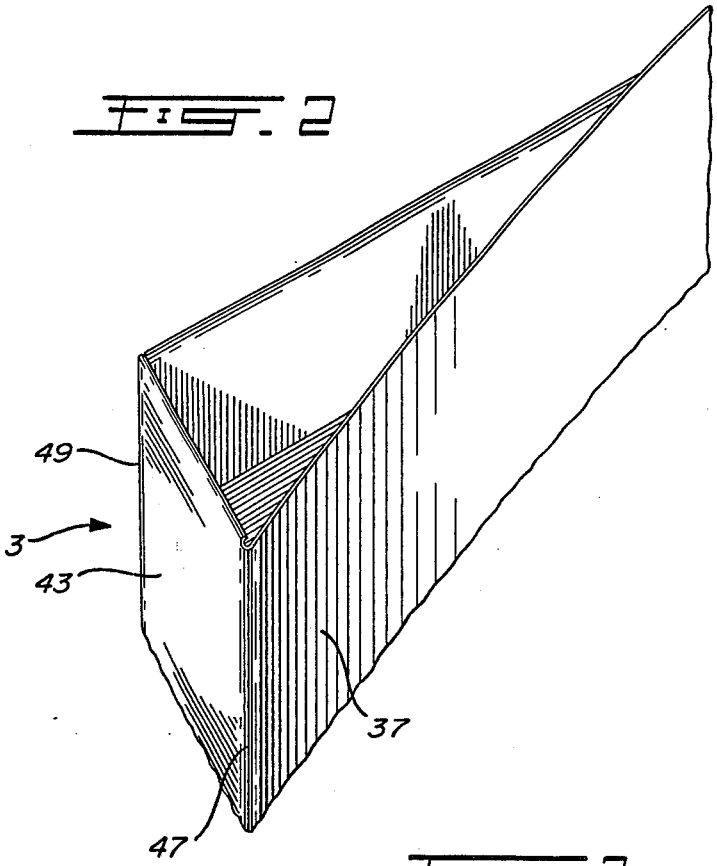
FIG. 2 is a partial perspective view showing a corner of the decorative module.
Figure 3:
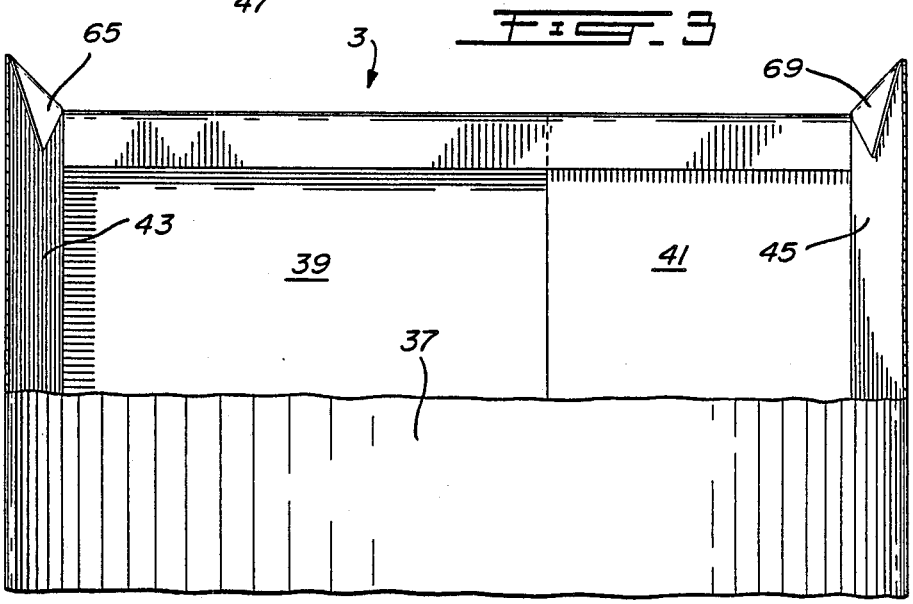
FIG. 3 is a front view with the concave face partly removed showing the inner structure of the decorative module according to the invention.

At the back of the sheet of aluminum 1 there are made in a manner known to those skilled in the art, rectilinear grooves 5, 7, 9, 11, 13, 15, 17, 19, 21, 23, 25 and 27. In addition, there are made four cuts, namely cuts 29, 31, 33 and 35. It should be noted that the cuts, 29, 31, 33, and 35, are made to reach exactly the respective junctions of grooves 5,13,21; 11,17,25; 5,15,23; and 11,19,27. With particular reference to FIGS. 2 and 3 of the drawings, it will be seen that the decorative module 3 according to the invention mainly consists of a rectangular shaped concave face 37, which, as seen from FIG. 1 of the drawings, is derived from an off centered intermediate portion of the sheet of material 1. The remaining portions of the sheet 1 obviously comprise a larger portion 39 and a smaller portion 41. As shown in FIG. 3 of the drawings, the larger portion folds over the smaller portion in a manner which will be explained more in details later.

The decorative module 3 also comprises angled borders 43 and 45 as particularly shown in FIGS. 2 and 3 which are formed along the two opposite edges 47,49 (FIGS. 2 and 3) of the concave face 37.

These angled borders 43,45 are formed by bending the sheet of material 1 along the two different rectilinear parallel grooves 7,9 and 5,11 formed in the sheet of material. As formed, each angled border 43,45 of the decorative module has a front edge 47 and a rear edge 49. It will be noted that only the front and rear edges of angled border 43 have been illustrated it being understood that the front and rear edges of the angled border 45 are exactly the same.

It has been mentioned above that cuts 29, 31, 33, 35 are made in the sheet of material. Reference is particularly made to FIG. 1 of the drawings for the particular location and arrangement of these cuts. It will be seen that these cuts are made in the sides 51 and 53 of the sheet of aluminum 1. With reference to FIG. 1, it will be seen that each cut is aligned with one rear edge 49 which coincides with a rectilinear groove 5,11 and reaches both ends of the rear edge. As shown in FIG. 1, these cuts 29, 31, 33, 35 will enable to produce folds 57, 59, 61, 63. These folds are formed by bending the sheet of material in the outer portions 39,41 respectively along rectilinear grooves 13, 15, 17, 19. Before proceeding to engage the outer portions 39,41 with one another in a manner which will be discussed later, it should be pointed out that the cuts 29, 31, 33, 35 define triangular portions 65, 67, 69, 71 with the ends of the front and rear edges of the angled borders 43,45. Before forming the decorative module, these triangular portions are inwardly bent against a corresponding angled border 43,45 in the manner shown particularly in FIG. 3 of the drawings at 65 and 67.

To give the decorative module its final shape, after having bent the sheet of material 1 along the rectilinear grooves in the manner indicated above, it is merely necessary to insert the outer portion 41 with the folds 57,59 already formed, into the folds 61,63 of the outer portion 39. This will provide an assembly which is self-contained, self-supporting and sufficiently rigid to keep its shape indefinitely.

Although the material of the sheet can vary to a large extent, it has been found that the best suitable material for this purpose is aluminum or an aluminum alloy. Of course, any other suitable sheet metal could be used.

In the model which has been illustrated, it will be noted that the concave face forms an arc of a circle. In this model, it has been found that the height of the arc of a circle is about 3 inches and that the chord is about 24 inches. It has been found, however, that the height could be as low as 1 inch whle providing a structure which is suitable for the various uses according to the present invention.

Figure 4:
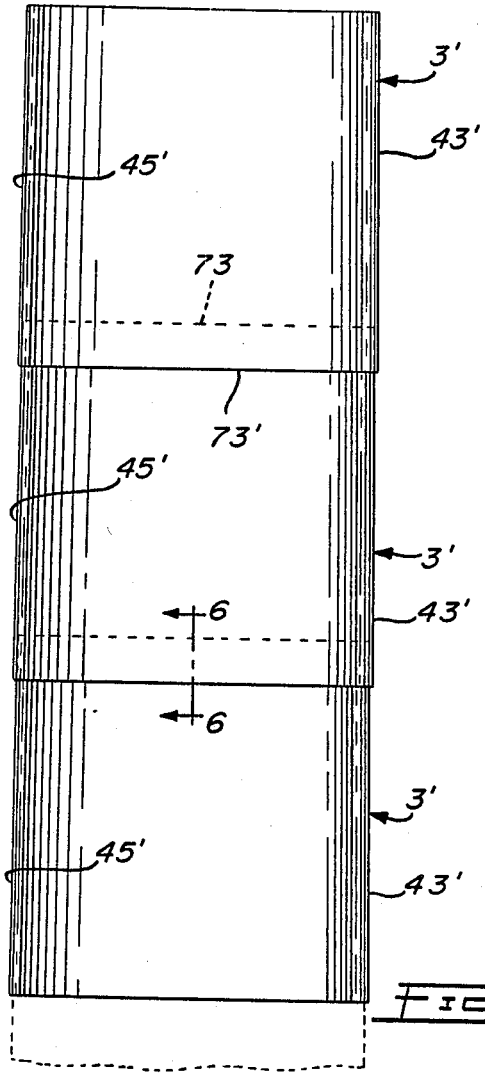
FIG. 4 is a front view showing the end to end connection of an alignment of decorative modules according to the invention.
Figure 6:
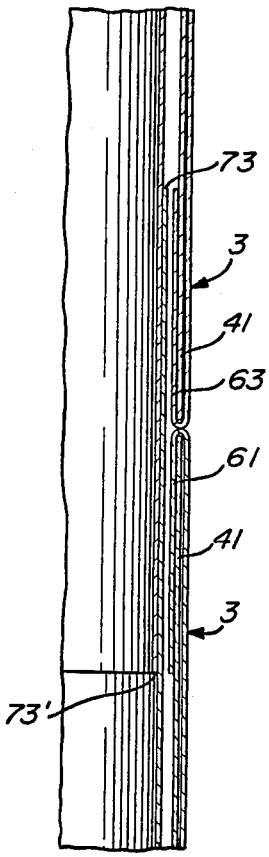
FIG. 6 is a section taken along line 6—6 of FIG. 4.
Figure 5:
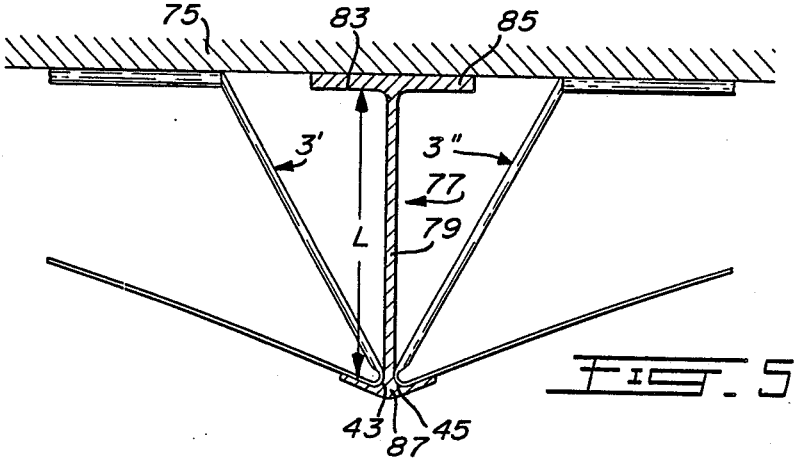
FIG. 5 is a cross-section view showing a bracket used for mounting decorative modules according to the invention in side by side relationship.

Turning now to FIG. 4, it will be seen that the decorative module 3' has slightly converging angled borders 43',45'. It will easily be realised that this arrangement will permit to align a series of decorative modules 3 in end to end relationship by embedding their adjacent ends 73,73' as particularly shown in FIG. 4.

This mounting of an alignment of decorative modules enables to use the module 3 according to the invention to decorate the outer face of a structure such as a building 75. To do so it is obviously necessary to provide an arrangement of side by side alignment of such modules. This is made possible by providing a bracket 77. The latter consists of a web portion 79 whose length L corresponds to the thickness of the decorative module 3' at the angle borders 43,45. The bracket 77 also comprises flanges 83,85, at one end, of standard construction enabling to mount the bracket against structure 75 in known manner. Finally, the bracket 77 is provided with V-shaped double catch 87 at the other end of the web 79. It will be seen that this double catch will engage oppositely facing angle borders 43,45 of two decorative modules 3',3'' placed side by side by catching their outer edges.

Of course, the decorative module according to the invention may lend itself to a plurality of other applications as it will readily be apparent to any one skilled in the art.

We claim:

1. A decorative module made of a single sheet of material, which comprises:

a rectangularly shaped concave face derived from an intermediate portion of said sheet of material, rearwardly and inwardly angled borders formed along two opposite sides of said concave face, and means enabling remaining portions of said sheet of material to fold at the rear of said concave face and to engage into one another to form a rigid structure, said concave face forming an arc of circle whose height is at least 1/25th the length of the chord of said arc of circle, so constructed and arranged that said module is self-supporting.

2. A decorative module according to claim 1, wherein said concave face is derived from an off centered intermediate portion of said sheet of material, said remaining portions comprising a larger portion and a smaller portion, said larger portion folding over said smaller portion.

3. A decorative module according to claim 2, wherein each angled border has a front edge and a rear edge, both said edges being formed by bending said sheet of material along two different rectilinear parallel grooves formed therein; said rear edge being shorter than said front edge.

4. A decorative module according to claim 3, which comprises cuts made in said sheet of material from both sides of said sheet of material adjacent said opposite sides, each said cut being aligned with one said rear edge and reaching both ends thereof, said cuts enabling to produce folds of said sheet of material parallel to said adjacent sides and perpendicularly to said rear edge, each said remaining larger and smaller portion thereby being formed with a pair of outer folds, the folds of said smaller portion being engaged by the folds of said larger portion, thus constituting the back of said decorative module.

5. A decorative module according to claim 4, wherein said cuts define triangular portions with the ends of said front edges and said rear edges, said triangular portions being inwardly bent against a corresponding angled border.

6. A decorative module according to claim 5, wherein each said border defines an acute angle with respect to said front face and an obtuse angle with respect to said back.

7. A decorative module according to claim 1, which is metallic.

8. A decorative module according to claim 7, which is made of aluminum.

9. A decorative module according to claim 7, which is made of an aluminum alloy.

10. A decorative module according to claim 1, wherein said angled borders are slightly converging so as to permit a series of said decorative modules to be aligned end to end with their adjacent ends embedded into one another.

11. A structure decorated with a plurality of modules aligned as defined in claim 10.

12. A structure as defined in claim 10, which comprises a bracket for mounting adjacent rows of said aligned modules, said bracket comprising a web member whose length corresponds to the thickness of said module at said angled border, flange means at one end of said web member for attachment to said structure, and V-shaped catching means at the opposite end of said web member to engage oppositely facing angled borders of two decorative modules placed side by side by catching outer edges thereof.

* * * * *